United States Patent [19]

Sarazen, Jr. et al.

[11] Patent Number: 4,715,532

[45] Date of Patent: Dec. 29, 1987

[54] ADJUSTABLY RESETTABLE, TEMPERATURE-RESPONSIVE AUTOMATIC VENTILATOR

[75] Inventors: Paul M. Sarazen, Jr., 214 Fairview Dr.; Dennis A. Beam, 410 Westfield Rd., both of Shelby, N.C. 28150

[73] Assignees: Paul M. Sarazen; Dennis A. Beam, both of Shelby, N.C.

[21] Appl. No.: 886,531

[22] Filed: Jul. 16, 1986

[51] Int. Cl.[4] ..... F24F 13/14

[52] U.S. Cl. ..... 236/49; 403/298

[58] Field of Search ..... 236/49, 101 D; 98/40, 98/25; 24/269, 71.2, 68 B, 68 BT, 49 C, 556; 411/418, 419, 500; 403/298

[56] References Cited

U.S. PATENT DOCUMENTS

| | | | |
|---|---|---|---|
| 569,235 | 10/1896 | Rockwell | 403/298 X |
| 866,943 | 9/1907 | Long | 24/49 C X |
| 1,250,308 | 12/1917 | Hanson | 24/556 |
| 1,672,234 | 6/1928 | Smith et al. | 24/556 X |
| 2,584,637 | 2/1952 | Sprinkle | 24/556 X |
| 2,664,899 | 1/1954 | Attias | 24/556 X |
| 4,090,733 | 5/1978 | Altschul | 24/562 X |
| 4,175,480 | 11/1979 | Beam, Jr. et al. | 236/49 X |
| 4,210,279 | 7/1980 | McSwain | 236/49 |
| 4,243,175 | 1/1981 | McSwain | 98/40.25 X |
| 4,290,554 | 9/1981 | Hensley | 236/49 |
| 4,395,799 | 8/1983 | Batts | 24/562 X |

*Primary Examiner*—William E. Tapolcai

*Attorney, Agent, or Firm*—Dority & Manning

[57] ABSTRACT

An automatic temperature responsive ventilator including a housing having side walls defining an air passageway and an openwork grid across the passageway. At least one shutter is mounted within the housing, with one end of one shutter element being associated with a bimetallic spring that is received within an opening in one housing side wall. An inner end of the spring is secured to a rod that is attached to the shutter. A setting plug is received in the opening in the side wall to hold the spring in place and to preset the tension in the spring which drives the shutter between an open and closed position relative to the passageway. Variations in ambinet temperature cause the shutter element to open and close automatically.

13 Claims, 8 Drawing Figures

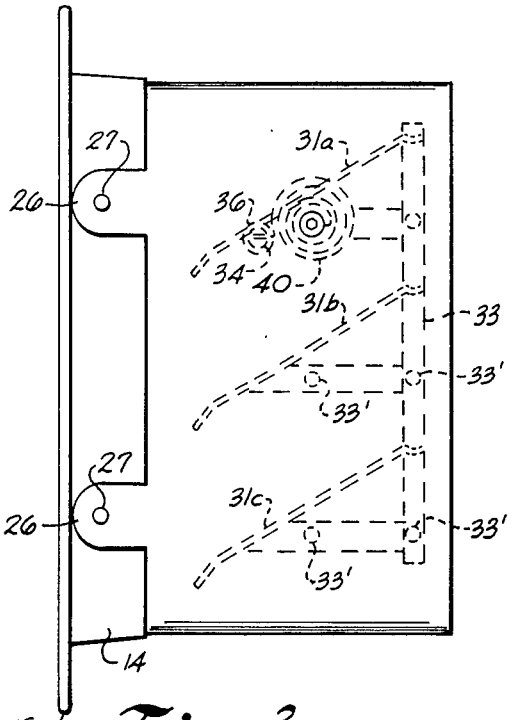
Fig. 3
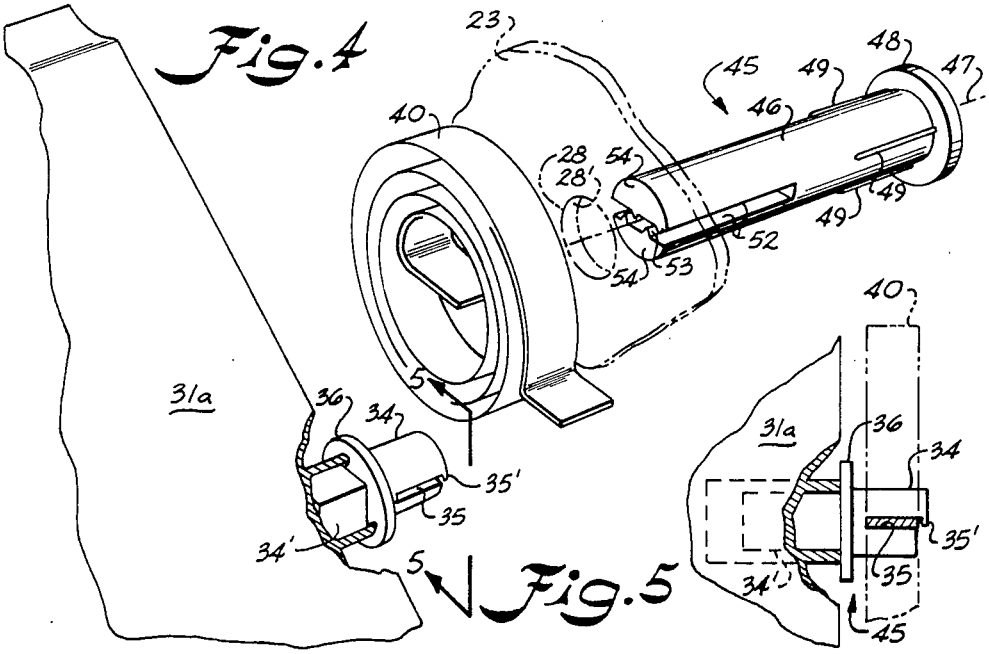
Fig. 4
Fig. 5

ADJUSTABLY RESETTABLE, TEMPERATURE-RESPONSIVE AUTOMATIC VENTILATOR

BACKGROUND OF THE INVENTION

The present invention relates to a ventilator structure of the type that is normally disposed in the foundation of a dwelling or other type building structure. Particularly, the present invention relates to a ventilator having a setting plug for a thermally responsive coil spring that, though exposed to ambient temperature for reaction thereto, is protected from the elements and possible damage due to mounting, and is directly connected to a shutter mechanism via a mounting means for same.

An automatic ventilator, such as shown in U.S. Pat. No. 4,210,279, has one or more shutters received in a passageway and connected by some means to a thermally responsive spring, such as a bimetallic spring, whereby the shutters automatically open and close, depending upon the ambient temperature. To facilitate use of such ventilators in different environments, it is desirable to be able to preset the thermally responsive spring for optimum performance in the particular environment of the ventilator.

SUMMARY OF THE INVENTION

It is an object of the present invention to provide an improved, automatic ventilator assembly suitable for mounting in the foundation of a dwelling structure or the like so as to control the ingress of air beneath the floor level of same.

Another object of the present invention is to provide an improved automatic ventilator structure that utilizes a tension-adjustable bimetallic spring for automatic opening and closing of shutter elements in the vent structure.

Yet another object of the present invention is to provide an improved ventilator assembly where the housing for same is molded of a synthetic, polymeric material and is unitary in structure and wherein a tension-adjustable bimetallic spring operable to automatically open and close shutter elements of the ventilator is received within one of the side walls of the housing so as to be exposed to ambient temperature while being protected from the elements.

Still further, another object of the present invention is to provide an improved automatic ventilator assembly that may be conveniently installed in existing openings in foundation walls without the need for mortar.

Generally speaking, the present invention relates to an automatic ventilator structure comprising a housing. The housing has peripheral side walls defining an air passageway therethrough. At least one shutter element is received in the air passageway and mounted to the housing for rotary movement between a closed position, where the passageway is generally closed, and an open position, where the passageway is generally open, to the passage of ventilating air therethrough. Temperature-responsive drive means are provided to move the shutter elements between varying degrees of the open and closed positions. A connecting means is operatively associated with the drive means and the shutter element whereby temperature variation effects on such drive means cause the shutter element to move toward an open or closed position. A setting plug is received in a setting opening defined in one of the side walls of the housing and secured against rotation therein. The plug also has means to secure the other end of the drive means thereto so that when the plug is secured against rotation, so is the drive means.

The temperature-responsive drive means preferably comprises a temperature responsive bimetallic spring. The connecting means which is operatively associated with the drive means and the shutter element preferably comprises a shutter connecting rod which is connected directly between one end of the bimetallic spring and the shutter element.

More specifically, the automatic ventilator of the present invention preferably includes a molded plastic housing that is unitary in structure insofar as side walls, protruding connector elements, and grid structure are concerned. Behind the grid structure and within the side walls are mounted a plurality of shutter elements that are interconnected for simultaneous movement. The side walls define an air passageway therebetween and through which ventilating air may pass or be excluded, depending upon the attitude of the shutter elements. One of the side walls further defines a setting opening, generally cylindrical in shape. The setting opening receives a setting plug having a receiving slot in which a bimetallic coil or thermally responsive spring is received. An outer end of the spring is received in the plug's receiving slot to secure this end of the spring in a fixed position. The plug's receiving slot is defined by two opposed gripping surfaces which preferably have a plurality of gripping teeth to engage and hold a portion of the spring in a fixed position. The spring is thus secured in place at one end thereof. Each of the gripping surfaces is carried by a member which extends longitudinally from one end of the body of the plug. An opposite end of the spring is received in one end of a slotted shutter connecting rod, an opposite end of which is secured to one of the shutter elements whereby temperature variations significant to produce an expansion or contraction effect on the coil spring cause the rod to rotate in the appropriate direction and to drive the shutter toward an open or closed position.

The setting plug is capable of being non-rotatably received within the side wall opening, and preferably this is accomplished by the provision of a plurality of setting ribs formed along the outer surface of one end of the setting plug and extending longitudinally along the length of the plug. Certain of the ribs are presented outwardly to engage an inner surface of the side wall opening. The plug has a flange which can be seated on the outer surface of the side wall when the plug is pushed into place inside the side wall's setting opening. An engagement cavity is formed in the flange end of the plug to non-rotatably receive an engagement tool which can be used to rotate the plug.

Protruding connector elements from the housing are provided to optionally receive a collar which may be secured thereto. The collar generally includes side walls defining an opening therewithin that corresponds in general to the size of the passageway of the ventilator housing and further has an outwardly extending peripheral flange around the side walls. A ventilator with a collar attached may be suitably employed in an opening, a foundation, or the like, with the protruding peripheral flange of the collar contacting an outer surface of the structure wall and covering any space between the vent housing and the wall per se.

BRIEF DESCRIPTION OF THE DRAWINGS

FIG. 3 is a side elevational view of a ventilator structure according to the teachings of the present invention.

FIG. 4 is an exploded, perspective view showing the assembly of the tension-spring setting plug, the bimetallic spring, and the shutter connecting rod of a ventilator structure according to teachings of the present invention.

FIG. 5 is an exploded partial view of an embodiment of the present invention taken along the line 5—5 of FIG. 4.

DESCRIPTION OF THE PREFERRED EMBODIMENTS

Figure 2:
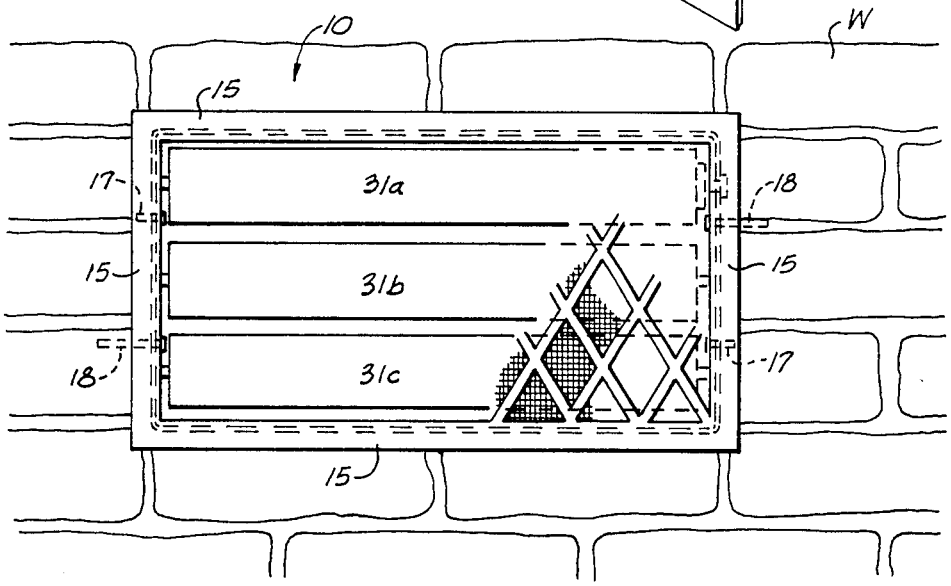
FIG. 2 is a front elevational view of a ventilator structure according to the present invention shown in its intended environment and illustrated partially in a cross section.

Referring to the figures, preferred embodiments of the present invention will now be described in detail. FIG. 2 for example, illustrates a ventilator according to teachings of the present invention in a preferred environment of use of same, that is a foundation wall W of a dwelling structure or the like where the ventilator provides means for ingress of ventilating air beneath the floor with the capability of controlling the amount of air depending upon ambient temperature. The ventilator generally indicated as 10 is thus shown mounted in the wall W. Under normal construction of the wall W from brick as shown, a rectangular shaped opening would be provided in the wall wherein the ventilator may be received and appropriately secured.

Figure 1:
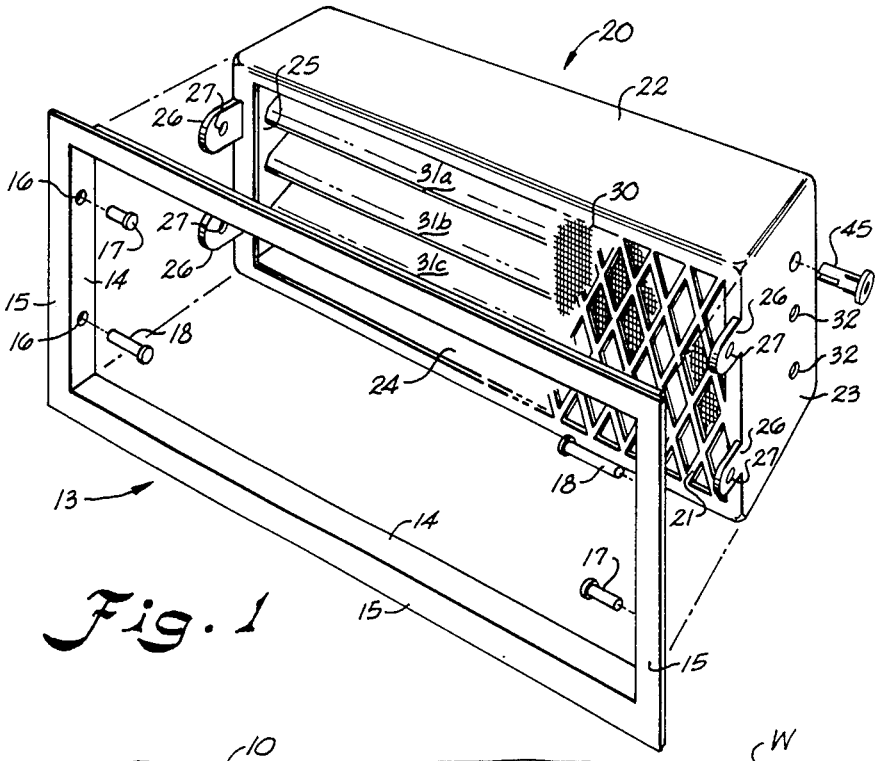
FIG. 1 is an isometric view of a ventilator structure according to the present invention.

As to the particular details of the preferred ventilator construction, a housing generally indicated as 20 is provided, being represented by an openwork grid structure 21 which is preferably of unitary construction with side walls 22, 23, 24 and 25. Side walls 22, 23, 24 and 25 define an air passageway in which a plurality of shutter elements 31*a*, 31*b* and 31*c* are received and mounted to side walls 23 and 25 by mounting elements 32 for limited rotary movement thereat between an opened and closed position, with the exception of one end of the shutter elements. As shown in FIG. 1, shutter element 31*a* has a special mounting at one end which will be described thereinafter. Housing 20 further has a plurality of protuberances 26, also referred to as ears 26, secured thereto having openings 27 therethrough.

A collar generally indicated as 13 may also be provided. Collar 13 is made up of a plurality of side walls 14 having peripheral flanges 15 secured thereto and extending outwardly therefrom. Collar 13 is thus received adjacent protuberances 26 and has openings 16 in certain of side walls 14 thereof that correspond to the openings 27 in protuberances 26 of housing 20. In this fashion and as shown for example in FIG. 2, collar 13 may be totally secured to protuberances 26 or certain of the matching openings may receive a securement pin 17 while certain receive an elongated element 18 that not only secures the collar to the housing, but extends into the side wall W so as to secure the ventilator in place. Utilizing collar 13 in this fashion, a ventilator 10 according to the present invention may be installed without the need for mortar, and moreover will fit various size openings in a foundation wall, where the difference between the size of the opening and the ventilator housing will be covered by the peripheral flange 15 of collar 13.

In a preferred situation, the housing and collar of the ventilator of the present invention are each of unitary construction, having been molded from a thermoplastic, polymeric material.

Housing 20 may further be provided with a screen 30 that is located behind grid 21 and secured in place. Screen 30 precludes the passage of insects through the air passageway of the ventilator structure. Referring particularly to FIGS. 4 and 6–8, one of the side walls, 23 as illustrated, further defines a generally cylindrical setting opening 28 for receiving a setting plug which is described below.

In accordance with the present invention, there is provided temperature responsive drive means for driving the ventilator between a condition open to the passage of air therethrough and a condition closed to the passage of air therethrough, depending upon the air temperature. As embodied herein and shown for example in FIG. 4, the temperature responsive drive means comprises a thermally responsive coil spring 40. Preferably, coil spring 40 is a bimetallic spring. Only a portion of spring 40 is illustrated in phantom in FIG. 3 for the sake of clarity.

In further accordance with the present invention, means are provided for operatively connecting the drive means to the shutter elements. As embodied herein and shown for example in FIG. 5, the means for operatively connecting the drive means to the shutter elements preferably comprises a shutter connecting rod 34 secured at one end 34' to shutter element 31*a* and having a slotted opposite end 35 in which the outer end of spring 40 is received and held by a lip 35'. End 34' of rod 34 is preferably non-circular in shape, and most preferably is rectangular as shown for example in FIG. 4. A like shaped hole in shutter element 31*a* receives end 34' whereby relative rotation between the two is precluded. Shutter connecting rod 34 further has a collar element 36 intermediate its length to properly position same with respect to spring 40 and the interior of housing side wall 23.

In accordance with the present invention, a spring-tension setting plug is provided for a ventilator drive spring. As embodied herein and shown for example in FIGS. 4–8, a spring-tension setting plug is indicated generally by the numeral 45. Plug 45 has an elongated cylindrical body 46 having a longitudinal axis 47 therethrough. A flange 48 extends from one end of body 46 in a direction normal to longitudinal axis 47. At the same end of body 46 as the flange, there are provided preferably a plurality of setting ribs 49 which extend from body 46 longitudinally along the outer surface of body 46. Setting ribs 49 also preferably extend radially outwardly from longitudinal axis 47 of body 46. Setting ribs 49 may reside against the clindrical inside surface 28' (FIG. 4) of setting opening 28 of side wall 23 and thus non-rotatably engage inside surface 28' of setting opening 28.

Plug 45 is preferably provided with an engagement cavity 50 (FIG. 8) which preferably comprises a cavity of non-circular transverse cross-section that extends longitudinally through flange 48 for a distance comprising less than the full length of body 46. Engagement cavity 50 is formed to receive an engagement tool (not shown), such as an Allen wrench, the purpose of which is described hereinafter.

Figure 6:
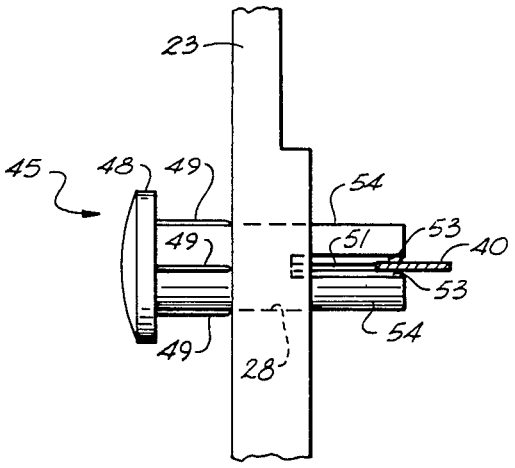
FIG. 6 is a side plan view of a portion of the ventilator of the present invention, including the plug of the present invention as shown in FIG. 4.

At the end of plug 45 opposite the end having flange 48, there is provided a receiving slot 51 which extends longitudinally from body 46. Receiving slot 51 is defined by a pair of opposed surfaces 52 which preferably have a plurality of gripping teeth 53 formed thereon. Each opposed surface 52 is carried by a member 54 which extends longitudinally from the end of body 46 opposite the flange end and preferably is of integral construction with body 46. As shown in FIG. 6, gripping teeth 53 preferably extend into slot 51 less than one-half the open width of slot 51 so that viewed from the side there is an unobstructed passageway extending through body 46 from one side to the other. Moreover, gripping teeth 53 preferably are mounted on gripping surfaces 52 in an alternating fashion so that a gripping tooth from one gripping surface is not directly opposed to a gripping tooth from an opposite gripping surface.

Operation of plug 45 is best understood by referring initially to FIGS. 4 and 6. In the position shown in FIG. 6, plug 45 rotates freely within setting opening 28. This is because setting ribs 49 have not engaged inside surface 28' of setting opening 28. In the position shown in FIG. 6, a setting tool (not shown), such as an Allen wrench, can be inserted into engagement cavity 50 to thereby facilitate rotation of plug 45 within setting opening 28. As further shown in FIG. 6, one end of spring 40 is received within receiving slot 51 of plug 45 and is non-rotatably held therein by engagement with gripping teeth 53, which are mounted on gripping surfaces 52 of members 54. Thus, as the setting tool is rotated and plug 45 rotates accordingly relative to setting opening 28, spring 40 also moves and causes shutter element **31*a* to open or close the air passageway, depending upon the direction of rotation of plug 45. This movement also is key to movement of additional shutter elements connected to shutter element 31*a*** to effect similar opening or closing of the air passageway of the ventilator structure.

Figure 7:
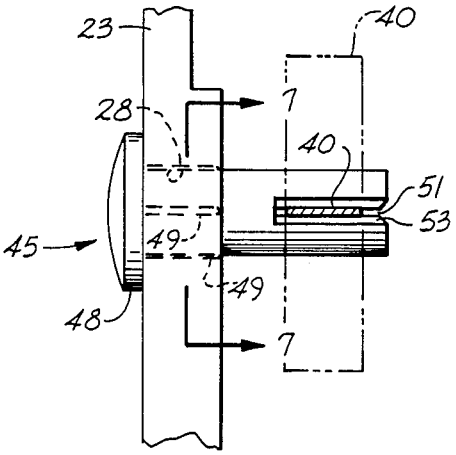
FIG. 7 is another side view of a portion of the ventilator of the present invention, including the plug of the present invention.
Figure 8:
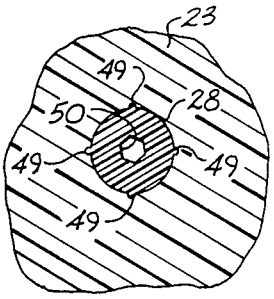
FIG. 8 is a cross-sectional view taken along the lines 8—8 of FIG. 7.

Setting plug 45 is preset at a position such that the shutter elements will provide maximum openness of the passageway at a particular temperature, for example 70° F., and minimum opennes, i.e., completely closed, at a second particular temperature, for example 30° F. Thus, the tension in spring 40 is preset to permit the shutter elements to open and close the passageway from completely open to completely closed over a particular temperature range, for example the 40° F. temperature range between 70° F. and 30° F. The temperature range and the temperature settings at the extremes of the range can be varied by the provision of different springs and by varying the position of setting plug 45 relative to setting opening 28. Once the desired degree of openness or closing of the air passageway is attained at a particular position of plug 45 relative to setting opening 28, setting plug 45 is pushed further into setting opening 28 until flange 48 engages the outside surface of side wall 23 as shown in FIG. 7. As plug 45 is pushed into setting opening 28, setting ribs 49 deform inside surface 28' of setting opening 28 to effect a non-rotatable engagement between plug 45 and setting opening 28. In this way, the position of spring 40 is preset for the desired position of relative opening or closing of the air passageway of the ventilator structure at the particular temperature at which the setting of spring 40 was performed.

To facilitate deformation of the inside surface of setting opening 28 by setting ribs 49, setting ribs 49 preferably are formed of a material capable of deforming the inside surface of setting opening 28. This can be accomplished by providing an inside surface 28' of setting opening 28 formed of a softer and more resilient material than the material forming setting ribs 49. Accordingly, setting plug 45 is preferably formed of polycarbonate such as the material known in the trade by the LEXAN trademark. Housing 20, including side wall 23 and inside surface 28' of setting opening 28, are preferably formed of a of a high-density polyethylene. The deformation of inside surface 28' by ribs 49 occurs without deforming ribs 49 during the process of deforming inside surface 28'.

Shutter elements **31*a*, 31*b* and 31*c* are preferably interconnected by an elongated strip 33 (FIG. 3) that extends therebetween within housing 20 and is secured to each shutter by studs 33' for pivotal movement. In this fashion, as spring 40 is affected by ambient temperature to contract or expand, shutter connecting rod 34 turns in the responsive direction and causes shutter element 31*a* to rotate towards a closed or an open position, depending upon the particular temperature. In like fashion, since connector strip 33** is secured between all of the shutter elements, all of the elements simultaneously move in the direction of an open or closed position.

Having described the present invention in detail, it is obvious that one skilled in the art will be able to make variations and modifications thereto without departing from the scope of the invention. Accordingly, the scope of the present invention should be determined only by the claims appended hereto.

what is claimed is:

1. An automatic ventilator comprising:

(a) a housing, said housing having peripheral side walls defining an air passageway therethrough;

(b) a setting opening defined in one of said side walls;

(c) at least one shutter element received in said air passageway and mounted to said housing for rotary movement between a closed position where the passageway is generally closed and an open position where the passageway is generally open to the passage of ventilating air therethrough;

(d) temperature responsive drive means operatively associated with said shutter element for driving said shutter element between said open and closed positions;

(e) a setting plug receivable in said side wall setting opening, said plug having at one end two opposed members extending outwardly therefrom and defining a receiving slot therebetween, said receiving slot receiving one end of said drive means, said receiving slot being defined by opposing members having at least one gripping tooth engageable with said drive means, said plug having at an opposite end means for securing said plug against undesired rotation relative to said setting opening so that said plug when inserted into said setting opening non-rotatably secures said one end of said drive means relative to said side wall, and said means for securing said plug being selectively rotatable in infinitely varying increments relative to said setting opening and securable therein by deforming said setting opening for adjusting said plug relative to said setting opening; and (f) whereby temperature variation effects on said drive means cause said shutter element to move toward an open or closed position.

2. An automatic ventilator as defined in claim 1, wherein said plug has a flange extending in a direction normal to said opposed members, at the end of said plug opposite the end with said opposed members.

3. An automatic ventilator as defined in claim 2 wherein said means for securing said plug against rotation includes at least one setting rib member extending from said flange end in a direction parallel to said opposed members and normal to said flange, said setting rib member engaging a cylindrical inside surface of said setting opening to preclude rotation of said drive means.

4. An automatic ventilator as defined in claim 3 wherein said housing is a plastic molded unit of unitary construction and said ribs are formed of material capable of deforming said inside surface of said setting opening upon insertion of said plug within said setting opening.

5. An automatic ventilator as defined in claim 1 wherein a plurality of interconnected shutter elements are provided, one of said shutter elements only being directly connected to said drive means.

6. An automatic ventilator as defined in claim 5 wherein said shutter elements are interconnected by an elongated element secured to an end of each shutter element.

7. An automatic ventilator as defined in claim 1 wherein said drive means is a bimetallic coil spring.

8. An automatic ventilator as defined in claim 1 wherein said housing further comprises an openwork grid structure secured to said side walls and extending across said passageway.

9. An automatic ventilator as defined in claim 1 further comprising a collar element secureable to said housing around one end thereof, said collar element having a peripheral flange therearound extending outwardly from said housing.

10. An automatic ventilator as defined in claim 9 wherein said housing has a plurality of ears secured thereto and extending outwardly therefrom, said collar being secured to at least certain of said ears.

11. An automatic ventilator comprising:

(a) a housing, said housing having peripheral side walls defining an air passageway therethrough, one of said side walls defining a cylindrical setting opening therethrough, said setting opening having a cylindrical inside surface;

(b) a plurality of shutter elements received in said air passageway and mounted to said housing for limited rotational movement, said shutter elements being interconnected for simultaneous movement between a closed position where said passageway is generally closed and an open position where said passageway is generally open;

(c) temperature responsive drive means for driving said shutter elements between said closed position and said open position;

(d) means for operatively connecting said drive means to said shutter elements; and (e) a setting plug, said plug receiving a free end of said drive means, said plug comprising a cylindrical body engageable with a portion of said side wall defining said cylindrical inside surface of said setting opening, said body having a plurality of setting ribs formed thereon and engageable with said cylindrical inside surface of said side wall to secure said plug against undesired rotation relative to said side wall, said setting ribs allowing said setting plug to be selectively rotatable in infinitely varying increments relative to said setting opening and securable therein by deforming said setting opening for adjusting said setting plug relative to said setting opening, said body having a receiving slot at an outer free end of same, said receiving slot being defined by opposing members having at least one gripping tooth engageable with said drive means.

12. An automatic ventilator as defined in claim 11 wherein said housing is of unitary construction and is molded of a synthetic polymeric material and said setting ribs are formed of a material capable of deforming said inside surface of said side wall upon insertion of said setting plug within said setting opening.

13. An automatic ventilator as defined in claim 11, wherein said operatively connecting means comprises a rod receiving another free end of said drive means and extending inwardly into said air passageway, one end of one of said shutter elements being secured to said rod.

* * * * *